US007073669B2

(12) United States Patent
McLemore

(10) Patent No.: US 7,073,669 B2
(45) Date of Patent: Jul. 11, 2006

(54) LAUNCHER FOR COMPRESSIBLE MATERIALS AND ASSOCIATED PROCESS

(75) Inventor: Michael D. McLemore, Peoria, IL (US)

(73) Assignee: Central Manufacturing Company, East Peoria, IL (US)

( * ) Notice: Subject to any disclaimer, the term of this patent is extended or adjusted under 35 U.S.C. 154(b) by 130 days.

(21) Appl. No.: 10/482,943

(22) PCT Filed: Jun. 25, 2003

(86) PCT No.: PCT/US02/22154

§ 371 (c)(1),
(2), (4) Date: Jan. 5, 2004

(87) PCT Pub. No.: WO03/004125

PCT Pub. Date: Jan. 16, 2003

(65) Prior Publication Data

US 2004/0211712 A1 Oct. 28, 2004

Related U.S. Application Data

(60) Provisional application No. 60/303,123, filed on Jul. 5, 2001.

(51) Int. Cl.
*B07C 5/00* (2006.01)

(52) U.S. Cl. ..... 209/642; 209/618; 209/689; 209/699

(58) Field of Classification Search ..... 209/642, 209/699, 689, 618
See application file for complete search history.

(56) References Cited

U.S. PATENT DOCUMENTS

| | | | | |
|---|---|---|---|---|
| 974,395 | A | 11/1910 | Kidder | |
| 2,081,182 | A | 5/1937 | Malke et al. | |
| 2,274,887 | A | 3/1940 | Collier | |
| 3,014,584 | A | 12/1961 | Kaufmann | |
| 3,552,563 | A | 1/1971 | Smith | |
| 3,757,800 | A * | 9/1973 | David et al. | 131/109.2 |
| 4,016,786 | A | 4/1977 | Körner | |
| 4,044,459 | A | 8/1977 | Burlingame | |
| 4,254,999 | A | 3/1981 | Davidson | |
| 4,276,940 | A | 7/1981 | Kirkegaard | |
| 4,375,775 | A | 3/1983 | Franz | |
| 4,474,334 | A | 10/1984 | Tatai et al. | |
| 4,739,641 | A | 4/1988 | Hering | |
| 5,080,234 | A * | 1/1992 | Benson | 209/212 |

(Continued)

FOREIGN PATENT DOCUMENTS

| | | |
|---|---|---|
| DE | 239954 | 2/1911 |

(Continued)

*Primary Examiner*—Kathy Matecki
*Assistant Examiner*—Terrell Matthews
(74) *Attorney, Agent, or Firm*—Husch & Eppenberger LLC

(57) ABSTRACT

A launcher (17, 50, 60) and an associated process for compressible materials (42) includes a frame (22), at least one upper roller (1), at least one lower roller (2) located below the at least one upper roller (1) within the frame (22), a transport mechanism (9) for transporting feed material between the at least one upper roller (1) and the at least one lower roller (2) and a rotational mechanism that is operatively connected to the at least one upper roller (1) and the at least one lower roller (2).

23 Claims, 10 Drawing Sheets

U.S. PATENT DOCUMENTS

| | | | | |
|---|---|---|---|---|
| 5,089,760 | A | 2/1992 | Joyner, Jr. | |
| 5,111,927 | A | 5/1992 | Schulze, Jr. | |
| 5,297,741 | A | 3/1994 | Zürn et al. | |
| 5,385,244 | A | 1/1995 | Kunig et al. | |
| 5,494,172 | A * | 2/1996 | Siesco, Jr. | 209/212 |

FOREIGN PATENT DOCUMENTS

| | | |
|---|---|---|
| DE | 1126661 | 3/1962 |
| DE | 3535633 | 9/1987 |
| EP | 0329865 | 8/1989 |
| EP | 0422460 | 4/1991 |
| GB | 301966 | 12/1928 |
| GB | 913349 | 12/1962 |
| GB | 942941 | 11/1963 |
| GB | 1327619 | 8/1973 |
| SU | 980864 | 12/1978 |

* cited by examiner

LAUNCHER FOR COMPRESSIBLE MATERIALS AND ASSOCIATED PROCESS

CROSS-REFERENCE TO RELATED APPLICATIONS

This application claims the benefit and priority of U.S. provisional application No. 60/303,123, filed 5 Jul. 2001.

TECHNICAL FIELD OF THE INVENTION

This invention generally relates to the area of recycling and, particularly, to separating compressible materials, e.g., foam, from other materials, e.g., metals, plastics, rubbers, textiles, fiber, glass, grit and so forth during a recycling process.

DESCRIPTION OF THE RELATED ART

Recycling has become a crucial aspect of our society due to the increasing scarcity of solid waste dumps as well as natural resources. It is important to be able to take a feed product produced from a variety of materials and separate the product back into the original materials for recycling.

A nonlimiting example of a product of this nature is an automobile. This is a complex product that includes metals, plastics, rubbers, textiles, fibers, glass, and grit. Prior to shredding, the traditional processes for dealing with automobiles were dismantling, baling, or chopping. In the early development of shredding technology, magnetic separation and primitive burning techniques were utilized to recover the ferrous materials. These processes produced significant pollution and some materials were left unprocessed and labeled as unusable waste. Even the non-ferrous material was considered one of these waste items. In order to improve this situation, the automobile recycling industry started using air separation, screening separation, and eddy current technology to remove all metallic components from the automobile for recycling. The remaining materials, e.g. foam, and plastic along with a small fraction of the rubber, textiles and fibers are still labeled as unusable or dirty waste.

However, some compressible materials, e.g. foam, are no longer considered "dirty" as technology is now available for the cleaning of these materials, which makes them fully capable of being recycled. However, the only process available for removing the compressible material, e.g., foam, is by a manual separation process. This activity is simply not cost effective and creates a very tedious and unrewarding job prone to human error and other quality issues.

The present invention is directed to overcoming one or more of the problems set forth above.

SUMMARY OF THE INVENTION

In one aspect of this invention, a launcher for compressible materials is disclosed. The launcher includes a frame, at least one upper roller, at least one lower roller located below the at least one upper roller within the frame, a transport mechanism for transporting feed material between the at least one upper roller and the at least one lower roller and at least one rotational mechanism that is operatively connected to the at least one upper roller and the at least one lower roller.

In another aspect of this invention, a first rotational mechanism that is operatively connected to the at least one upper roller and a second rotational mechanism that is operatively connected to the at least one lower roller is disclosed.

Yet another aspect of this invention is that either the first or second rotational mechanism or both are variable speed motors.

Still another aspect of this invention is that the transport mechanism can be an endless belt conveyor.

Another aspect of this invention is that the transport mechanism can be at least one rotating assist roller.

Yet another aspect of this invention is that the at least one rotating assist roller is operatively connected to a variable speed motor.

Still another aspect of this invention is that the variable speed motors are controlled by a torque control adjustable speed drive, e.g. variable frequency inverter.

In another aspect of this invention, a process for separating compressible materials is disclosed. The process includes transporting compressible material between at least one upper roller and at least one lower roller located below the at least one upper roller and ejecting the compressible material from the at least one upper roller and at least one lower roller due to the rotation of both the at least one upper roller and the at least one lower roller.

These aspects of the invention are merely illustrative of the innumerable aspects associated with the present invention and should not be construed as limiting in any manner.

BRIEF DESCRIPTION OF THE DRAWINGS

For a better understanding of the present invention, reference may be made to the accompanying drawings in which.

DETAILED DESCRIPTION OF THE INVENTION

Figure 1A:
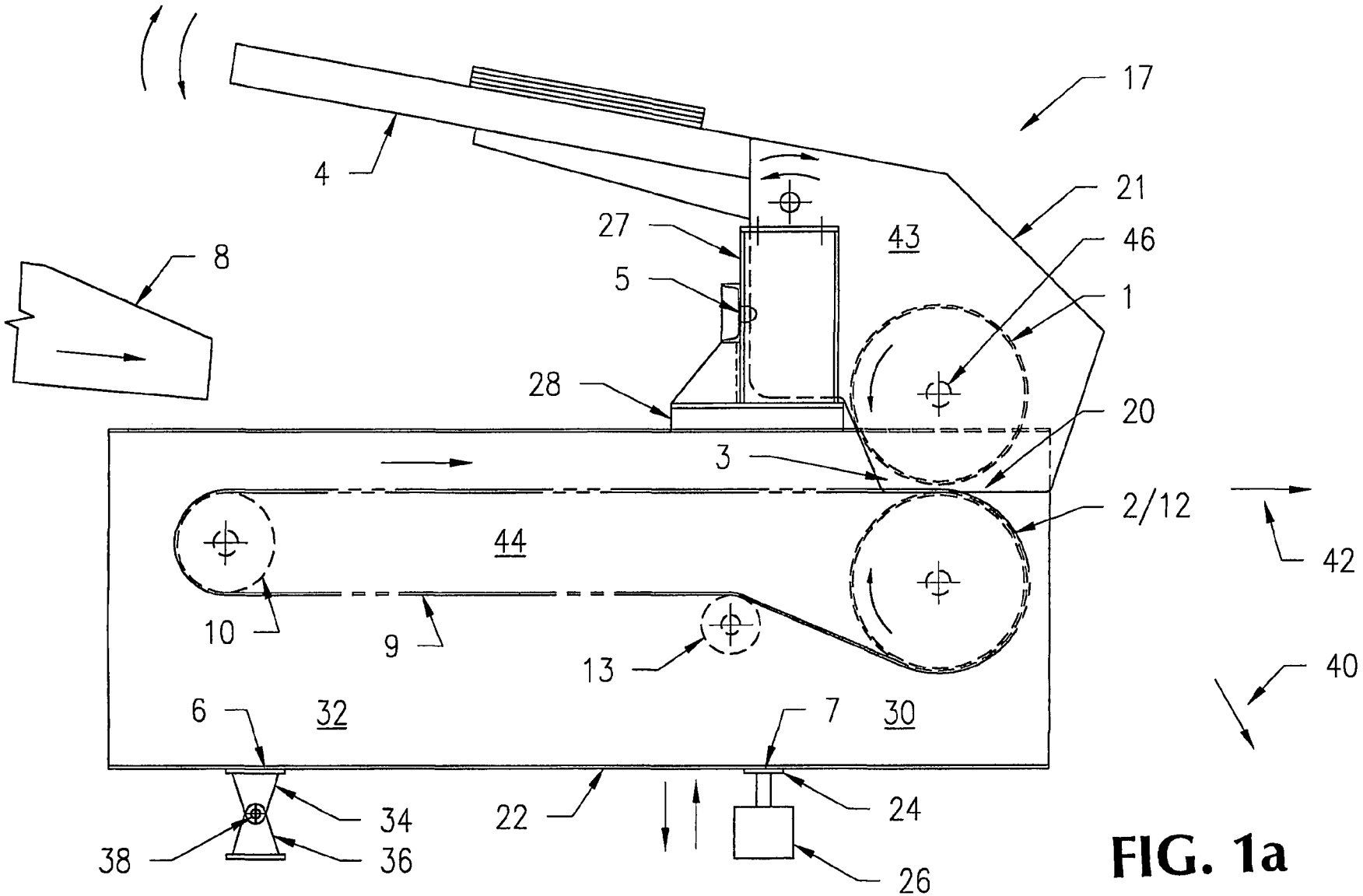
FIG. 1*a* is a side schematic view of a preferred embodiment of the compressible material launcher of the present invention utilizing a belt conveyor, which encircles a lower compression roller/drive pulley, a tail pulley and a snub pulley.

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention. Identical components will receive the same reference numerals throughout the embodiments.

Compressibles 42 are defined throughout this application as not only foam but also any preferably dry material that is collapsible and capable of being compressed. The preferred type of feed material is from automobile shredder residue; however, any feed input comprised of materials where some of the materials are compressible can be utilized with this Invention.

Figure 1B:
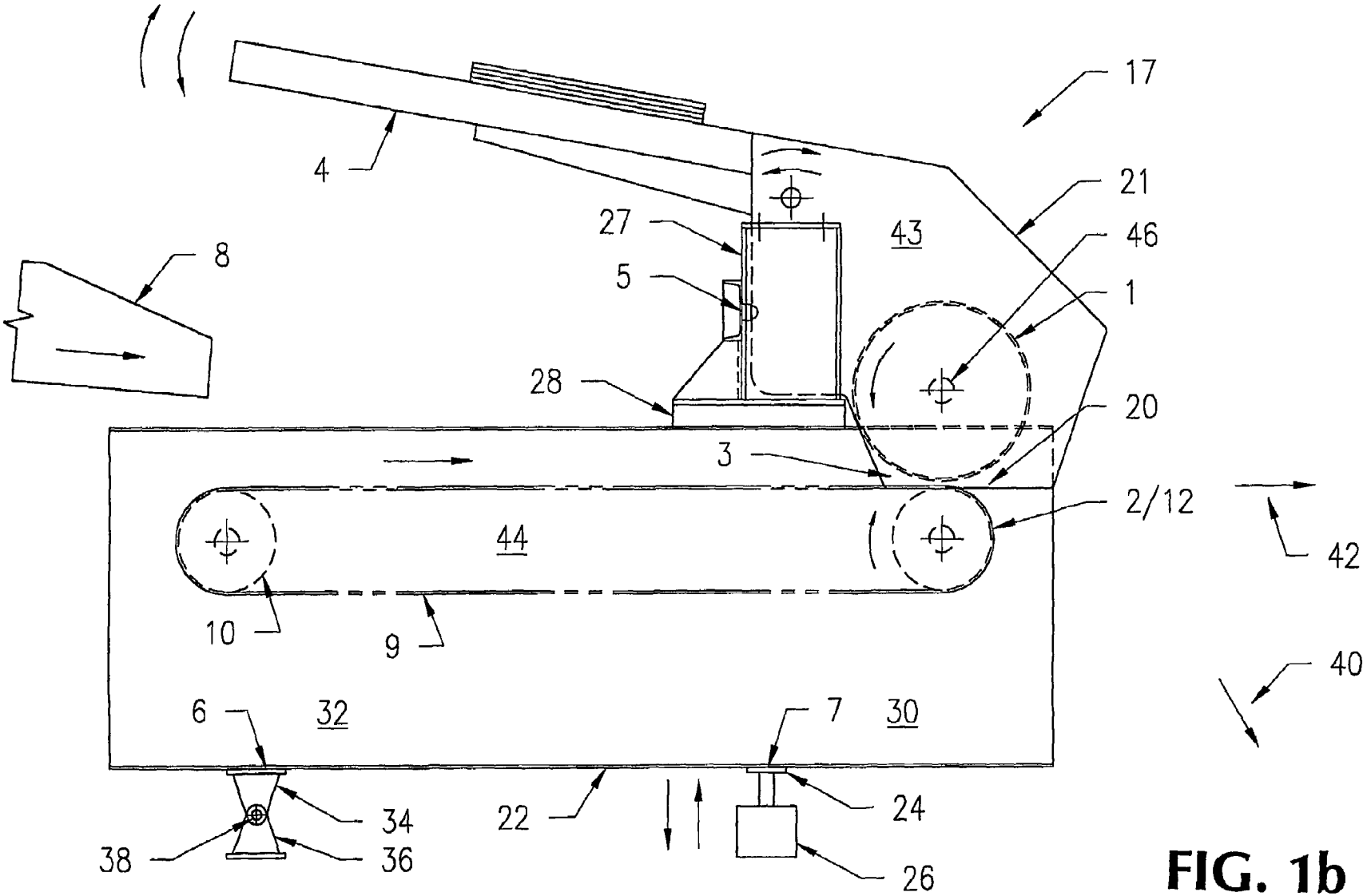
FIG. 1*b* is a side schematic view of a first alternative embodiment of the compressible material launcher of the present invention utilizing a belt conveyor, which encircles a lower compression roller/drive pulley and a tail pulley.

Referring to the drawings of the embodiment shown in FIGS. 1*a* and 1*b*, a launcher for compressible material 42 with a belt conveyor 9 of the full belt type is generally indicated by numeral 17.

Figure 2A:
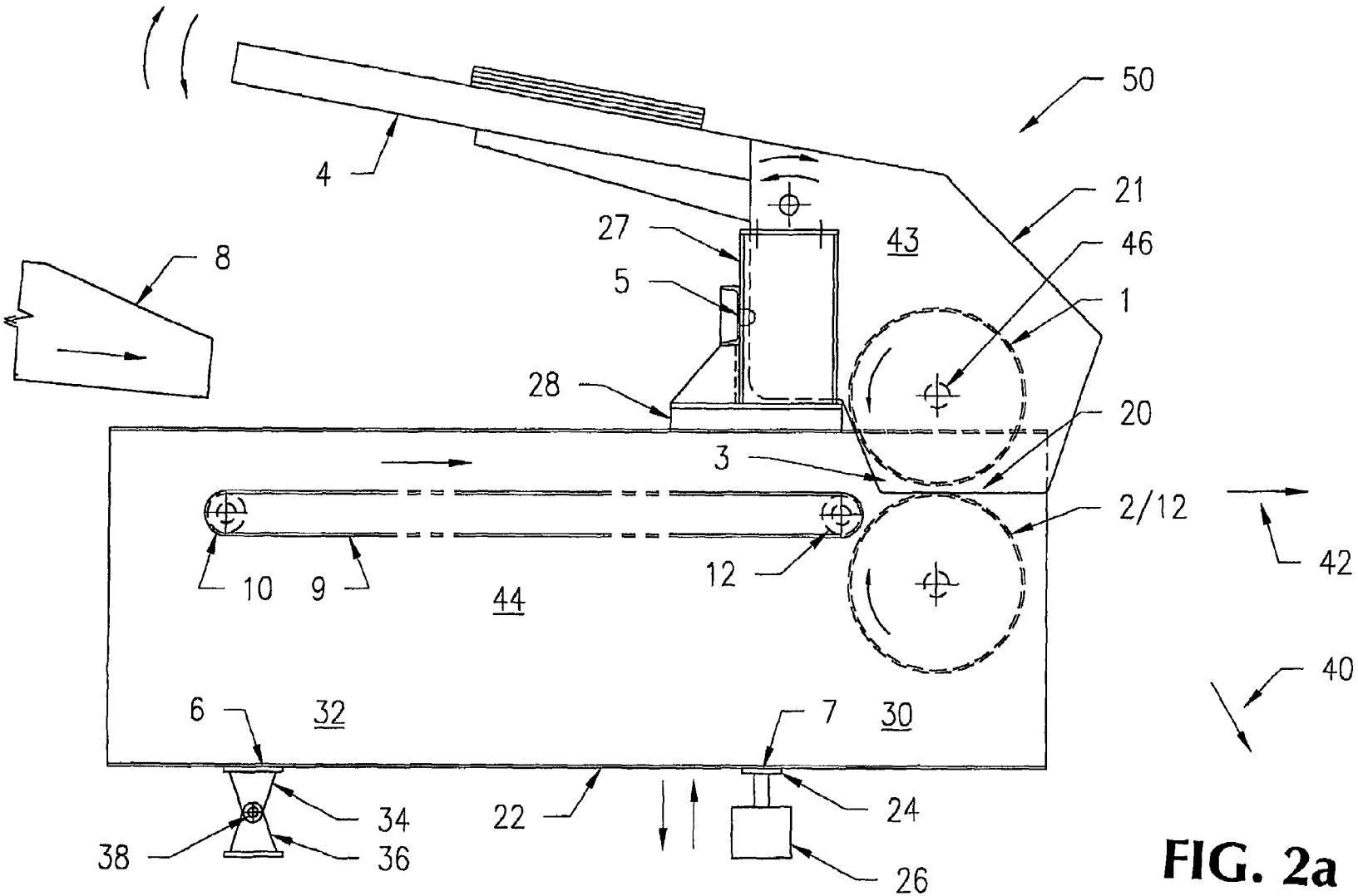
FIG. 2*a* is a side schematic view of a second alternative embodiment of the compressible material launcher of the present invention utilizing a belt conveyor, which encircles a drive pulley and a tail pulley.
Figure 2B:
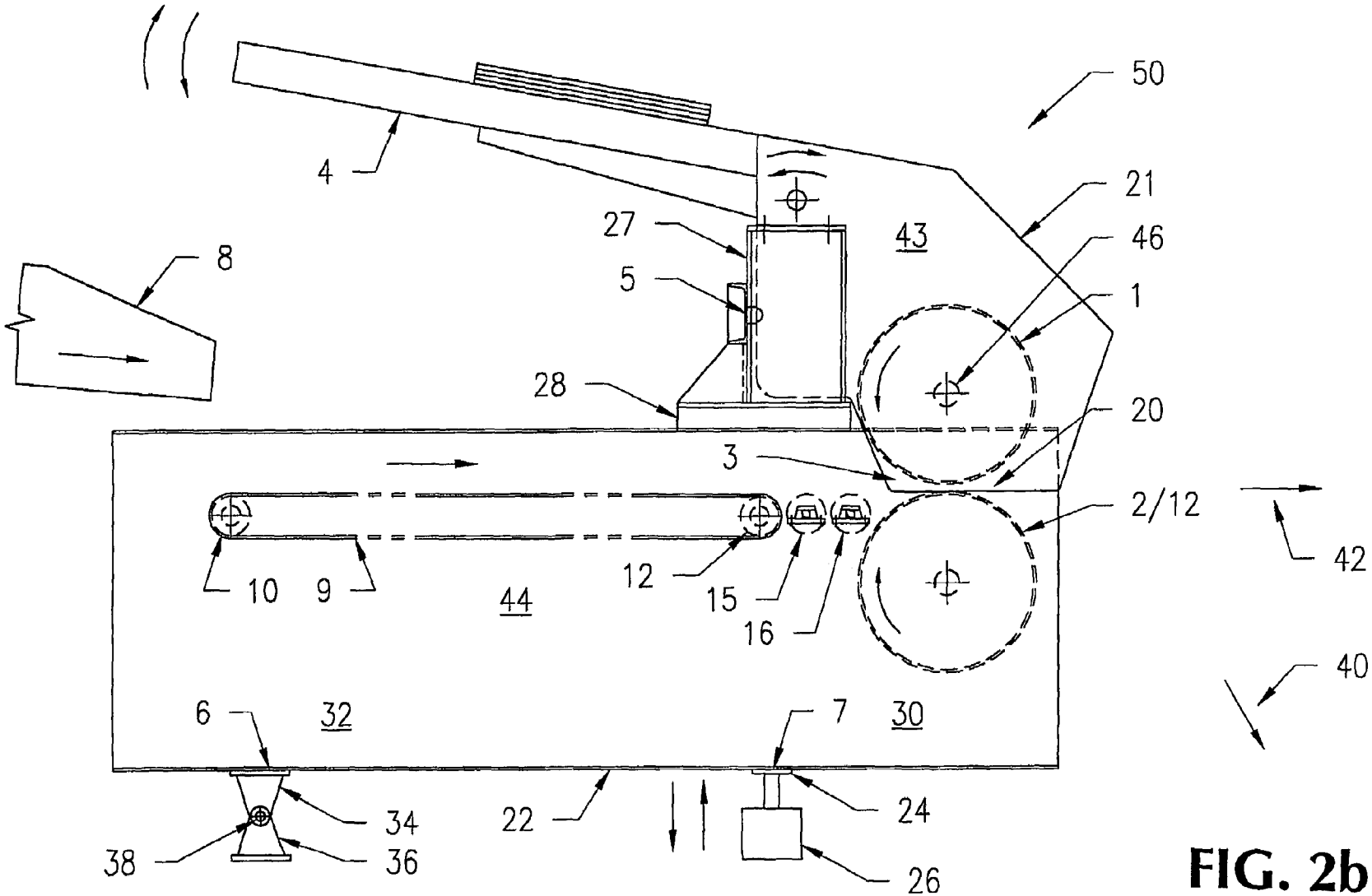
FIG. 2*b* is a side schematic view of a third alternative embodiment of the compressible material launcher of the present invention utilizing a belt conveyor with assist rollers and where the belt conveyor encircles a drive pulley and a tail pulley.
Figure 2C:
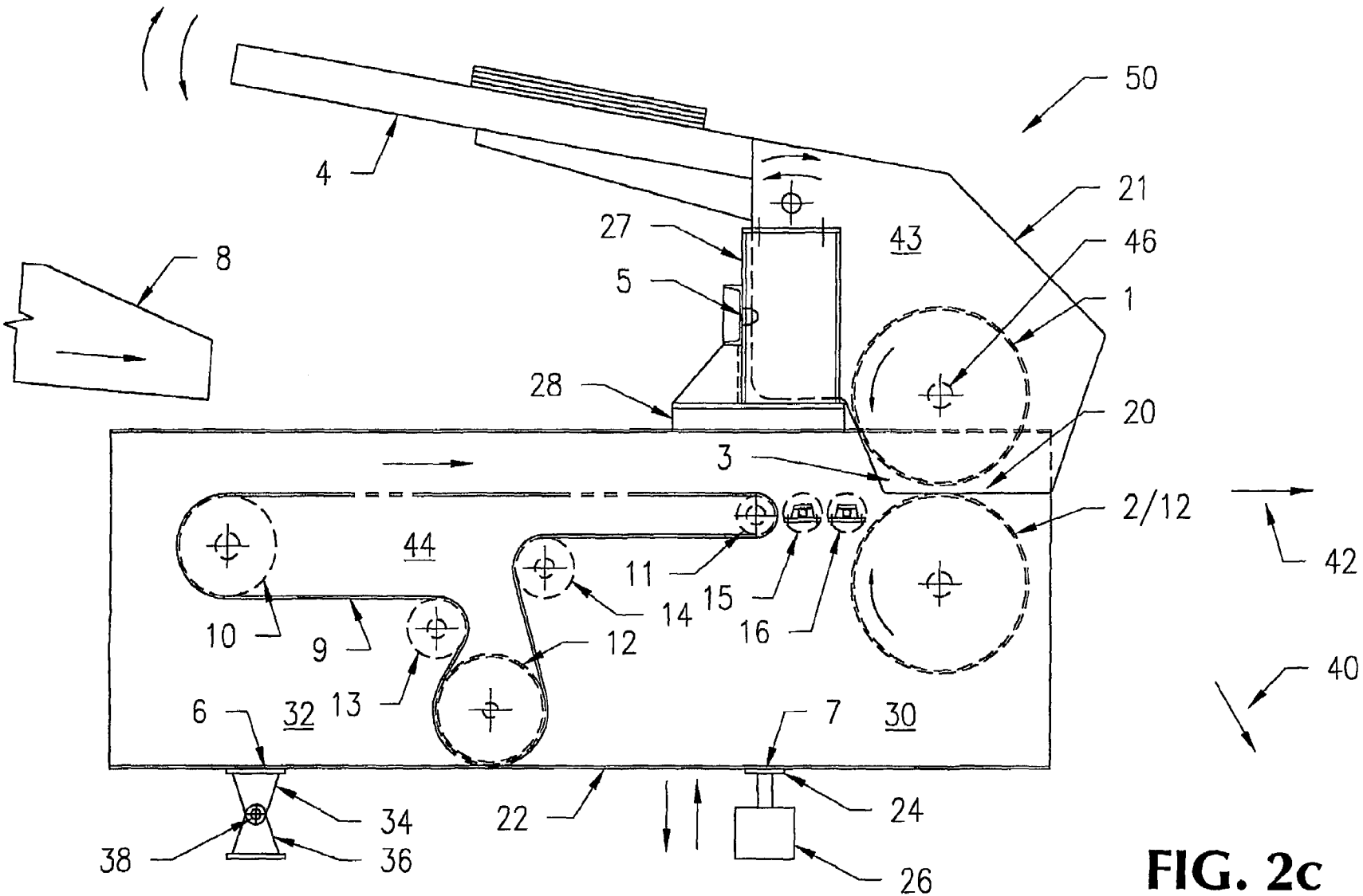
FIG. 2*c* is a side schematic view of a fourth alternative embodiment of the compressible material launcher of the present invention utilizing a belt conveyor with assist rollers and where the belt conveyor encircles a head pulley, at least one snub pulley, a drive pulley and a tail pulley.

Referring to the drawings of the embodiment shown in FIGS. 2*a*, 2*b*, and 2*c*, a launcher for compressible material 42 with a belt conveyor 9 of the partial belt type is generally indicated by numeral 50.

Figure 2D:
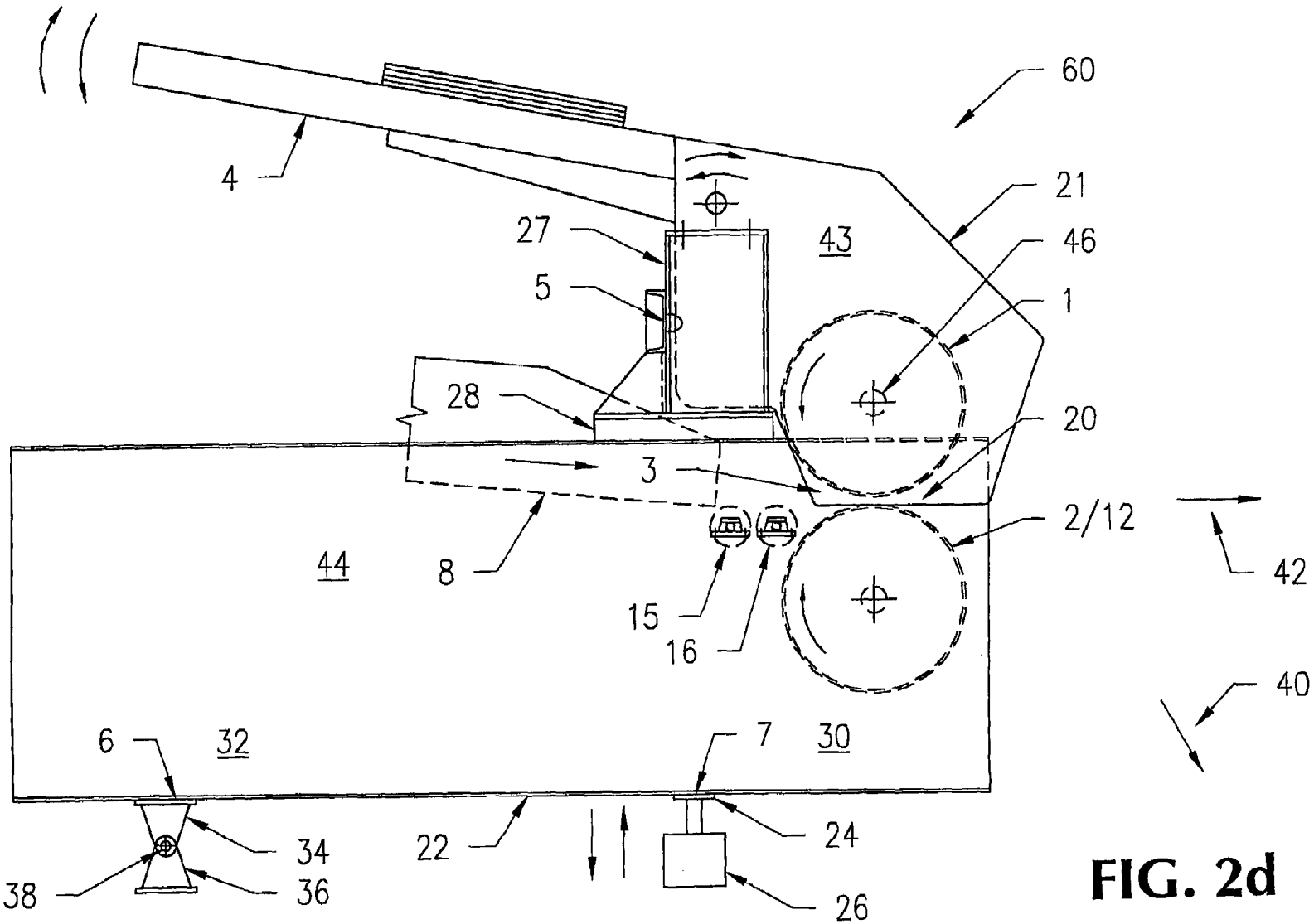
FIG. 2*d* is a side schematic view of a fifth alternative embodiment of the compressible material launcher of the present invention utilizing rotating assist rollers without a belt conveyor.

Referring to the drawings of the embodiment shown in FIG. 2*d*, a launcher for compressible material 42 without a belt conveyor 9 is generally indicated by numeral 60.

For the preferred, first, second, third, fourth and fifth embodiments, which are explained in greater detail hereinafter, the compressible material, e.g., foam, will be thrown or launched primarily due to the rotations of the compression rollers 1 and 2, respectively. Moreover, the compression rollers 1 and 2 are preferably made or coated with a non-oxidizing material (e.g., stainless steel). Sensors (not shown) are strategically placed throughout the launcher 17, 50 or 60 and the locations are not meant to be limiting. Preferably, the sensors are optical sensors. Sensors could be placed a distance away from the upper and lower compression rollers 1 and 2 in the direction towards the material delivery machine 8 to sense a back up of material being feed to the launcher 17, 50 and 60 via the material conveying belt 9. The distance the sensor is placed away from the upper and lower compression rollers 1 and 2 will depend on the application, but it is preferably at least three feet away from the compression rollers 1 and 2 toward the material delivery machine 8. The sensors will sense a back up and signal the operator and/or shutdown the launcher 17, 50 and 60. In another example, sensors detect the number of pieces entering an area prior to the variable nip point or clearance gap 3 and detect the number of pieces exiting the variable nip point or clearance gap 3. If there is different number of pieces entering than exiting, this difference is indicated to the operator or the launcher 17, 50 and 60 is shutdown.

All of the embodiments of the launcher 17, 50, 60 include a lower frame 22 with a front portion 30, a rear portion 32 and sidewalls 44. The lower frame 22 provides support for the drum pulleys and all other associated equipment utilized in this Invention.

All of the embodiments of the launcher 17, 50, 60 also include an upper frame 21 with sidewalls 43 that provides support for at least one upper compression roller 1 and an adjustable counterweight 4. The upper frame 21 is preferably, but not necessarily, rotatably attached via a shaft 46 and preferably, but not necessarily, to at least one flange bearing 47 or to at least one pillow block bearing 48 to an upper frame support 27 with a series of nut and bolt combinations (not shown).

The upper frame 21 is operatively connected to the lower frame 22 by an upper frame attachment 28 that is preferably, but not necessarily, fully adjustable and controllable by mechanical, electromechanical, hydraulic, or pneumatic means (not shown). At least one shock absorber 5 provides a cushioned contact point between the upper frame 21 and the lower frame 22. The space directly behind and between the upper compression roller 1 in frame 21 and the lower compression roller 2 in frame 22 is defined as the nip point or clearance gap 3.

The normal-mode nip point or clearance gap 3 is adjustable thru the above referenced attachment system 28 in a range from approximately 0.125 inches (0.3175 centimeters) to 4 inches (10.16 centimeters) with a preferred nip point or clearance gap 3 in a range from approximately 0.50 inches (1.27 centimeters) to 3 inches (7.62 centimeters). All sizes of compressible material 42 and sizes of non-compressible materials 40 that are smaller than the normal operative nip point or clearance gap 3 will be drawn in and processed.

All sizes of non-compressible material 42 that are larger than the normal-mode nip point or clearance gap 3 are drawn in and allowed to force the upper compression roller 1 up, defining a bypass-mode nip point or clearance gap 3. An adjustable counterweight 4 that is preferably, but not necessarily, fully controlled by mechanical, electromechanical, hydraulic, or pneumatic means (not shown) restores the normal-mode nip point or clearance gap 3 between the upper compression roller 1 and the lower compression roller 2 after the material piece is past a launch point 20.

The speed of an upper compression roller 1 and a lower compression roller 2, among other things, determines the velocity and distance that the compressible material 42, e.g., foam, is ejected from the launch point 20. The upper compression roller 1 is to rotate preferably, but not necessarily, at ten times the speed of the lower compression roller 2. An externally mounted variable speed drive system (not shown) is operatively connected to shaft 46 of the upper compression roller 1. The upper compression roller 1 can rotate in a range from approximately 125 to 2,000 revolutions per minute and preferably in a range from approximately 250 to 1,000 revolutions per minute. An externally mounted variable speed drive system (not shown) is operatively connected to shaft 46 of the lower compression roller 2. The lower compression roller 2 can rotate in a range from approximately 125 to 2,000 revolutions per minute and preferably in a range from approximately 25 to 100 revolutions per minute. When the lower compression roller 2 is encircled with a material conveying belt 9, the feed material will move at a speed from approximately 25 to 600 feet per minute to preferably in a range from approximately 100 to 300 feet per minute.

On the underside of the lower frame 22 and in contact with the front portion 30 is an adjustment mechanism 7 to adjust the trajectory of the materials leaving the launch point 20. The adjustment mechanism 7 includes a pivoting support pad 24 that is threadedly adjustable in a support base 26. The adjustment mechanism 7 can elevate the front portion 30 of the launcher 17 in a range from approximately zero to ten degrees and preferably in a range from approximately five to eight degrees. A pivot assembly 6, fixed to the underside of the lower frame 22 and towards the rear portion 32, allows the front portion 30 of the launcher 17 to be elevated up or down as the adjustment mechanism 7 is actuated up or down. The pivot assembly 6 includes a top pivot support member 34 that is attached to the bottom of the frame 22, a bottom pivot support member 36 that is capable of attachment to another machine, flooring or frame (not shown) and a pivot pin 38 that rotatably connects the top pivot support member 34 to the bottom pivot support member 36.

The feed material enters the launcher 17 by means of a material delivery machine 8. This material delivery machine 8 is preferably a vibratory-type conveyor such as disclosed in U.S. Pat. No. 5,297,741, issued Mar. 29, 1994, which is incorporated herein by reference. An alternative material delivery machine 8 is a belt conveyor (not shown) or a fixed chute (not shown). The reason a vibratory-type conveyor is utilized is to provide a singular, i.e., piece by piece, flow of the feed material into the launcher 17. This is to provide separation efficiency between any two pieces of feed material, so each piece enters the nip point or clearance gap 3 independently. Although, non-compressible material 40 might be capable of some limited compression, it does not fall under the definition of compressible materials, as previously defined above.

The feed material leaves the material delivery machine 8 and sequentially drops onto a moving material conveying belt 9. An external drive system (not shown) or a drum motor (not shown) is preferably, but not necessarily, used to drive the material conveying belt 9. A drum motor is a motorized pulley that has a motor, gears, shafts, and bearings located within an enclosed structure. The motor is enclosed within a circular outer structure, where this circular outer structure rotates via gears that are operatively connected to the motor. It is preferred, but not necessary, that a drum motor not be utilized as a drive pulley 12 for moving the material conveying belt 9 when it would also be serving as a compression roller 1/2.

The material conveying belt 9 can utilize snub pulleys 13/14 that are preferably, but not necessarily, drum pulleys that are located near the drive pulley 12 to increase the amount of wrap around the drive pulley 12 or for controlling the belt path.

However, for the alternative embodiments beginning as shown in FIG. 2*b*, once the feed material passes from the material conveying belt 9 or if no belt exists, a first rotating assist roller 15 and a second rotating assist roller 16 further advance the feed material. Both the first rotating assist roller 15 and the second rotating assist roller 16 can be operatively connected to a single variable speed motor through gearing. The first rotating assist roller 15 can rotate in a range from approximately 25 to 600 revolutions per minute and preferably in a range from approximately 100 to 300 revolutions per minute. The second rotating assist roller 16 can rotate in a range from approximately 25 to 600 revolutions per minute and preferably in a range from approximately 100 to 300 revolutions per minute.

The material enters the nip point or clearance gap 3 of the externally driven compression rollers 1 and 2. The compressible materials 42 will shoot out a significant distance while the non-compressible items 40 will drop out or project a short distance. This is due to the fact that the compression rollers 1 and 2 are unable to grip and apply the same projective frictional force to non-compressible materials 40 to the same extent as compressible materials 42. An adjustable splitter hopper (not shown) can be used for collecting the separated non-compressible materials 40 having minimal compressibility and the compressible materials 42.

An illustrative, but nonlimiting example of a material conveying belt 9 is that made of interwoven polyester yarns that are impregnated with polyvinyl chloride as manufactured by Apache Hose and Belting Co., Inc. having a place of business at 4805 Bowling St. SW, Cedar Rapids, Iowa 52406.

An example of a drum motor is manufactured by Van der Graaf Inc. having a place of business at 2 Van der Graaf Court, Brampton, Ontario L6T 5R6 Canada. Another example of a drum motor is found in U.S. Pat. No. 4,276,940, which issued on Jul. 7, 1981 and is incorporated herein by reference.

The external drive systems (not shown) are preferably, but not necessarily, electrical motors. Illustrative, but nonlimiting examples, include a Model 566-A motor manufactured by LINCOLN® Electric Motor Division of the Lincoln Electric Company having a place of business at 22801 St. Clair Avenue, Cleveland, Ohio 44117, a 48-S254T frame for a motor manufactured LEESON ELECTRIC MOTORS® located at 2100 Washington Street, Grafton, Wis. 53024-0241, and a TOSHIBA® polyphase motor manufactured by Toshiba International Corporation, Industrial Equipment Division having a place of business at 13131 W. Little York Rd., P.O. Box 40906, Houston, Tex. 77040 are among numerous types of acceptable motors.

To provide speed and torque control to motors utilized throughout this application, variable frequency inverters are preferably utilized. An example is found in U.S. Pat. No. 5,089,760, which issued on Feb. 18, 1992, which is incorporated herein by reference. A preferred, nonlimiting example of a frequency inverter includes the MICROMASTER™, MIDIMASTER™ or COMBIMASTER™ variable frequency inverters for AC motors up to ninety (90) kilowatts. These variable frequency inverters are manufactured by Siemens Corporation having a place of business at the Citicorp Center located at 153 East 53rd Street, New York, N.Y. 10022-4611.

Another torque control device that may be utilized is the TOSHIBA® S9 Series, Adjustable Speed Drive manufactured by the Toshiba International Corporation, Industrial Division having a place of business located at 13131 West Little York Road, Houston, Tex. 77041.

An illustrative, but nonlimiting, example of the drum pulleys, hub bushings, and shafts utilized with this invention can be acquired from Precision Pulley & Idler, Inc. having an address at P.O. Box 287, Pella, Iowa 50219-0287.

An illustrative, but nonlimiting, example of the flange bearing 47, pillow block bearing 48, take-up bearing 64, and take-up frame 62 utilized with this invention can be acquired from Dodge Manufacturing Corporation, having a place of business at 6040 Ponders Court, Greenville, S.C. 29615.

Figure 3:
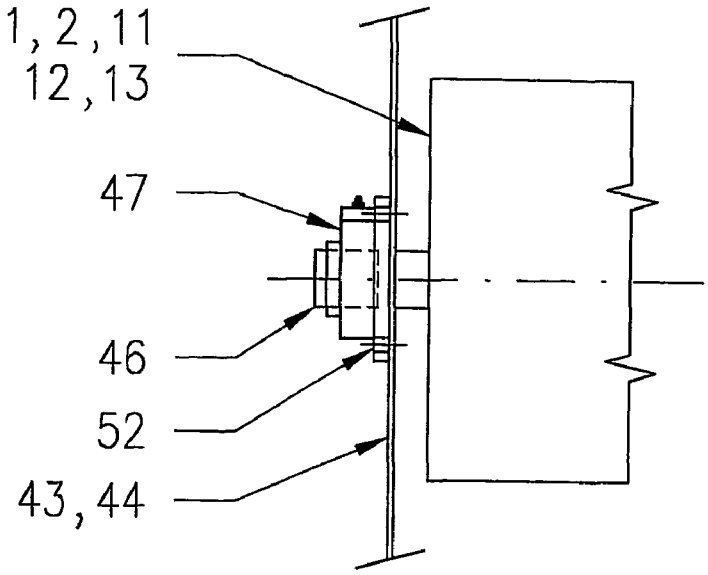
FIG. 3 is an isolated perspective view of a drum pulley with associated flange bearing either rotatably connected to an external drive or not and operating as a compression roller, drive pulley, head pulley, or snub pulley of the present invention.
Figure 4:
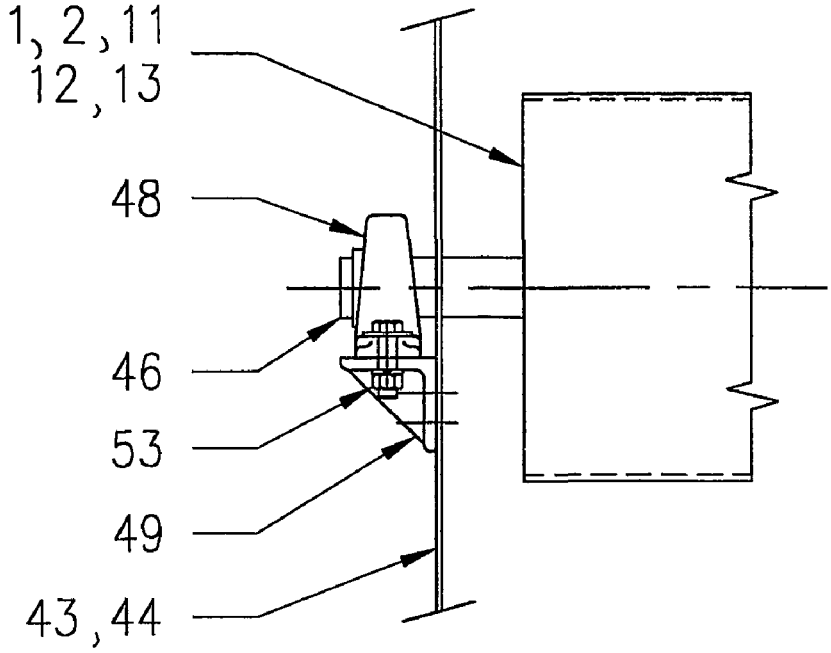
FIG. 4 is an isolated perspective view of a drum pulley with associated pillow block bearing either rotatably connected to an external drive or not and operating as a compression roller, drive pulley, head pulley, or snub pulley of the present invention.

The upper compression roller 1 and lower compression roller 2/drive pulley 12 is preferably, but not necessarily, a drum pulley that is rotatably attached to the lower frame sidewall 44 via a shaft 46 to either a flange bearing 47 or a pillow block bearing 48 as shown in FIGS. 3 and 4, respectively.

Figure 3A:
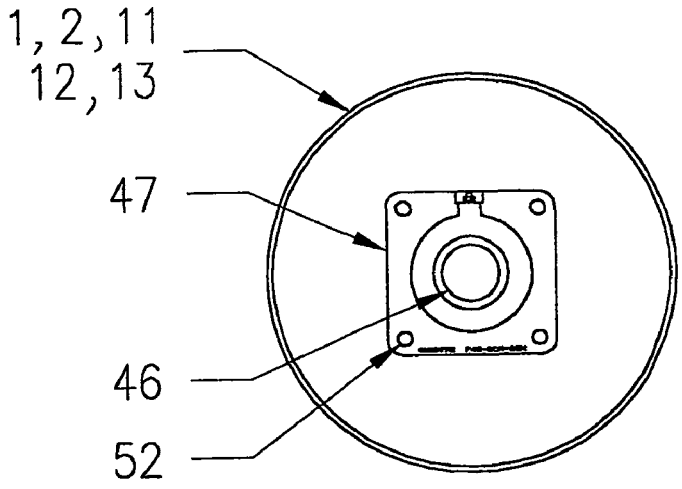
FIG. 3*a* is a side view of the drum pulley with associated flange bearing shown in FIG. 3, either rotatably connected to an external drive or not and operating as a compression roller, drive pulley, head pulley, or snub pulley of the present invention.

As shown in FIG. 3*a*, the flange bearing 47 is attached to the lower frame sidewall 44 by a first series of four (4) nut and bolt combinations 52.

Figure 4A:
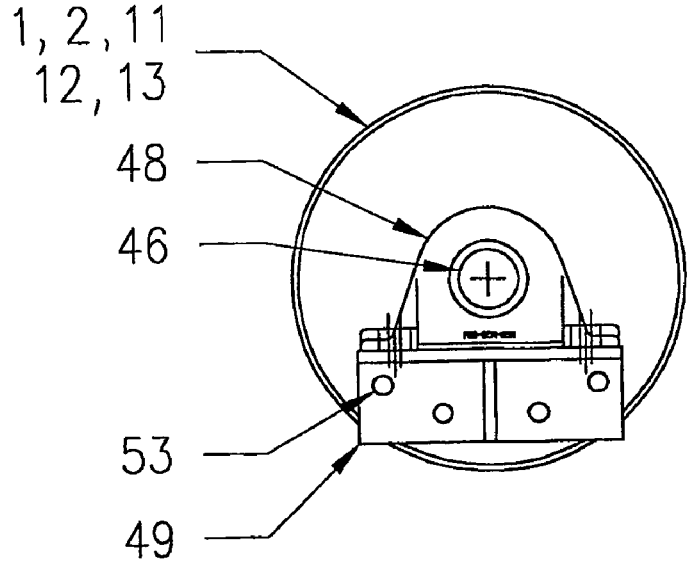
FIG. 4*a* is a side view of the drum pulley with associated pillow block bearing shown in FIG. 4, either rotatably connected to an external drive or not and operating as a compression roller, drive pulley, head pulley, or snub pulley of the present invention.

As shown in FIG. 4*a*, the pillow block bearing 48 located on top of an "L-shaped" bracket 49 is attached to the lower frame sidewall 44 by a second series of four (4) nut and bolt combinations 53.

Figure 6:
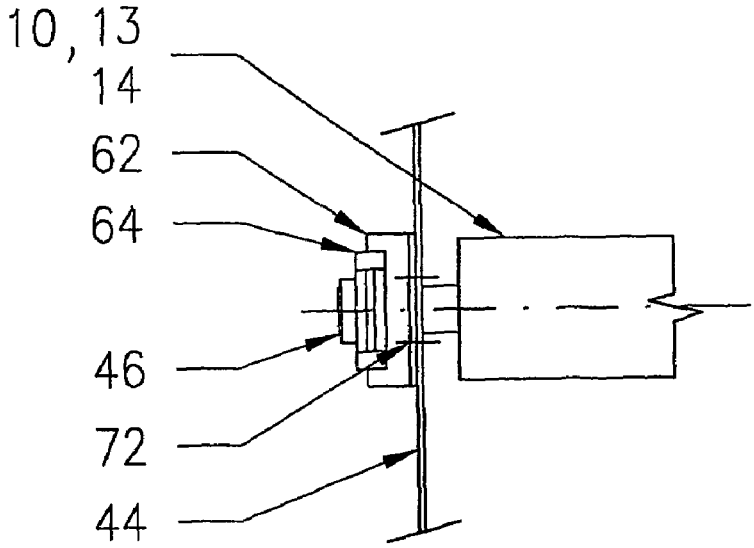
FIG. 6 is an isolated perspective view of a tube pulley, drum pulley, or solid pulley with an associated take-up bearing within a take-up frame and operating as a tail pulley or snub pulley of the present invention.
Figure 6A:
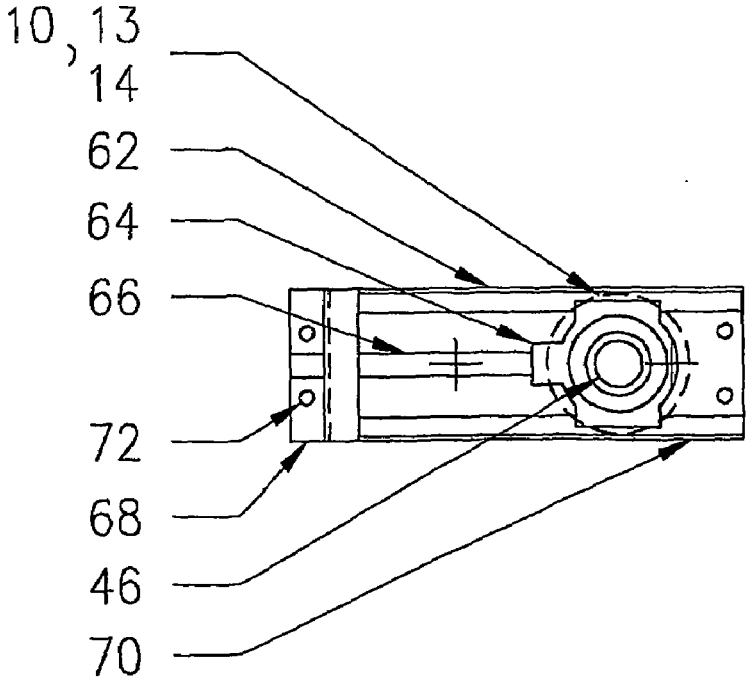
FIG. 6*a* is a side view of the tube pulley, drum pulley, or solid pulley, shown in FIG. 6, with an associated take-up bearing within a take-up frame and operating as a tail pulley or snub pulley of the present invention.

The tail pulley 10 is preferably, but not necessarily, a drum pulley that is rotatably attached to the lower frame sidewall 44 via a shaft 46 to a take-up bearing 64 mounted within a take-up frame 62 as shown in FIGS. 6 and 6*a*, respectively.

As shown in FIG. 6*a*, the take-up bearing 64 mounted within a take-up frame 62 is attached to the lower frame sidewall 44 by a fourth series of four (4) nut and bolt combinations 72. The tail pulley 10 can be moved laterally along the length of the take-up frame 62 by utilizing a threaded member 66 that operatively connects a take-up bearing 64 located at the take-up frame 62 second end 70 to a captured threaded adjuster located at the take-up frame 62 first end 68.

The snub pulleys 13 and 14 are preferably, but not necessarily, drum pulleys that are rotatably attached to the lower frame sidewall 44 via a shaft 46 to a flange bearing 47, a pillow block bearing 48, or a take-up frame 62 with a take-up bearing 64 as shown in FIGS. 3, 4, and 6 respectively. The snub pulley 13/14 can be moved laterally along the lower frame sidewall 44 by utilizing push blocks (not shown) with the flange bearing 47 or the pillow block bearing 48 or along the length of the take-up frame 62 by utilizing a threaded member 66 that operatively connects a take-up bearing 64 located at the take-up frame second end 70 to a captured threaded adjuster located at the take-up frame first end 68.

As shown in FIG. 3*a*, the flange bearing 47 is attached to the lower frame sidewall 44 by a first series of four (4) nut and bolt combinations 52.

As shown in FIG. 4*a*, the pillow block bearing 48 located on top of an "L-shaped" bracket 49 is attached to the lower frame sidewall 44 by a second series of four (4) nut and bolt combinations 53.

As shown in FIG. 6*a*, the take-up bearing 64 mounted within a take-up frame 62 is attached to the lower frame sidewall 44 by a fourth series of four (4) nut and bolt combinations 72.

Figure 5:
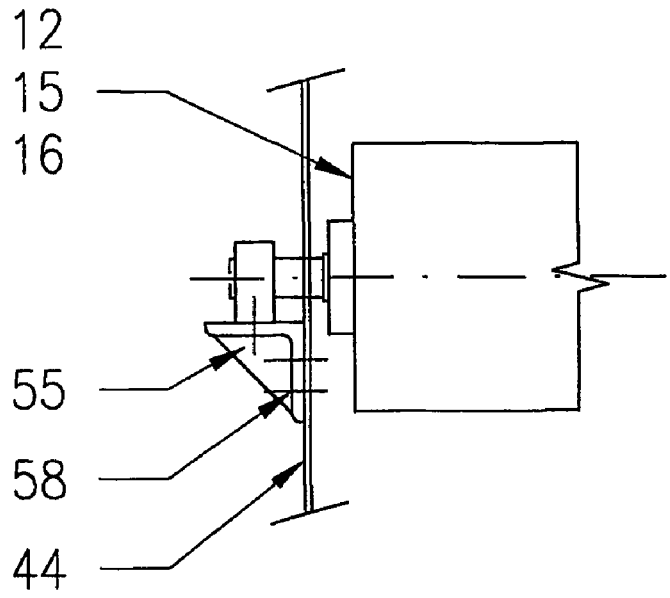
FIG. 5 is an isolated perspective view of a drum motor, having an internal drive, with an associated support bracket and operating as a drive pulley or assist roller of the present invention.
Figure 5A:
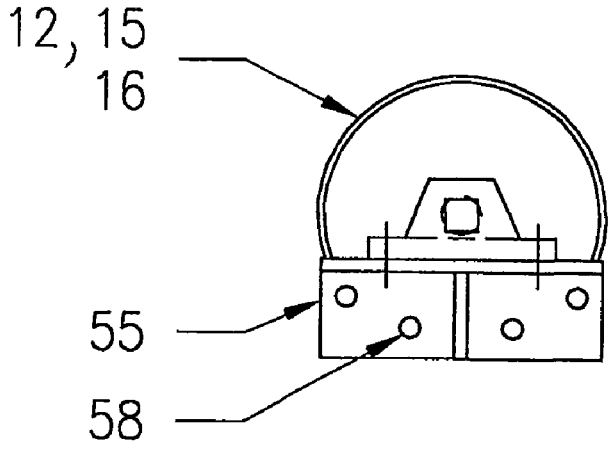
FIG. 5*a* is a side view of the drum motor, having an internal drive, shown in FIG. 5, with an associated support bracket and operating as a drive pulley or assist roller of the present invention.

A drum motor serving as a drive pulley and not in a compression roller position, as a rotating assist roller 15 and/or as a rotating assist roller 16 is preferably, but not necessarily, rotatably attached via a support bracket 54 located on top of an "L-shaped" bracket 55 that is attached to the lower frame sidewall 44 by a third series of four (4) nut and bolt combinations 58 as shown in FIGS. 5 and 5*a*, respectively.

The preferred, first alternative, second alternative, third alternative, fourth alternative and fifth alternative embodiments of the invention are merely illustrative of the innumerable embodiments associated with the present invention and should not be construed as limiting in any manner.

Referring now to the drawing of the preferred embodiment shown in FIG. 1*a*, a launcher for compressible material 42 with a full belt conveyor is generally indicated by numeral 17. It utilizes an upper frame 21 and a lower frame 22 as previously described above, a material conveying belt 9 that encircles the at least one lower compression roller 2 (which also functions as the drive pulley 12), a tail pulley 10, and a snub pulley 13. Assist rollers 15/16 are not utilized. A drum motor is not used for the drive pulley 12.

Referring now to the drawing of the first alternative embodiment shown in FIG. 1*b*, a launcher for compressible material 42 with a full belt conveyor is generally indicated by numeral 17. It utilizes an upper frame 21 and a lower frame 22 as previously described above, a material conveying belt 9 that encircles the at least one lower compression roller 2 (which also functions as the drive pulley 12), a tail pulley 10. A snub pulley 13 and assist rollers 15/16 are not utilized. A drum motors is not used for the drive pulley 12.

Referring now to the drawing of the second alternative embodiment shown in FIG. 2*a*, a launcher for compressible material 42 with a partial belt conveyor is generally indicated by numeral 50. It utilizes an upper frame 21 and a lower frame 22 as previously described above, a material conveying belt 9 that encircles the drive pulley 12 and a tail pulley 10. A snub pulley 13 and assist rollers 15/16 are not utilized. A drum motor is preferably, but not necessarily, used for the drive pulley 12.

Referring now to the drawing of the third alternative embodiment shown in FIG. 2*b*, a launcher for compressible material 42 with a partial belt conveyor is generally indicated by numeral 50. It utilizes an upper frame 21 and a lower frame 22 as previously described above, a material conveying belt 9 that encircles the drive pulley 12 and a tail pulley 10. Rotating assist rollers 15/16 are utilized. A snub pulley 13 is not utilized. A drum motor is preferably, but not necessarily, used for the drive pulley 12.

Referring now to the drawing of the fourth alternative embodiment shown in FIG. 2*c*, a launcher for compressible material 42 with a partial belt conveyor is generally indicated by numeral 50. It utilizes an upper frame 21 and a lower frame 22 as previously described above, a material conveying belt 9 that encircles the head pulley 11, drive pulley 12, tail pulley 10, and a pair of snub pulleys 13 and 14. Rotating assist rollers 15/16 are utilized. A drum motor is preferably, but not necessarily, used for the drive pulley 12.

Referring now to the drawing of the fifth alternative embodiment shown in FIG. 2*d*, a launcher for compressible material 42 without a belt conveyor is generally indicated by numeral 60. It utilizes an upper frame 21 and a lower frame 22 as previously described above. A material conveying belt 9 is not utilized. Rotating assist rollers 15/16 are utilized.

INDUSTRIAL APPLICABILITY

The present invention is advantageously applicable in separating compressible materials, e.g. foams, from harder materials having minimal compressibility. This is due to the fact that the harder materials are typically flatter and have less of a friction bond than compressible materials. There are a number of variables that affect the quality of separation. This includes the launch angle provided by the trajectory adjuster 7, the variable nip point or clearance gap 3, the feet per minute of any conveyors, the revolutions per minute of rotating assist rollers 15 and 16 and lastly but certainly not least, the revolutions per minute speed and distance between and materials of the upper and lower compression rollers 1 and 2, respectively. The trajectory, projectile or launch angle is preferably ten degrees. However, the set-up of the launcher 17, 50 or 60 will dictate the precise trajectory, projectile or launch angle. This launcher 17, 50 or 60 will remove the large pieces of compressible material from a flow of other materials in a fast and efficient manner without using any hand sorting.

The above advantages are only for the purposes of illustration and are not intended to limit the present invention as such. It will be recognizable, by those skilled in the art, that the present invention is suitable for a plurality of other applications. In view of the foregoing, it is readily apparent that the subject support device in a very simple and effective manner allows the removal of compressible materials from a stream of feed materials in a fast and effective manner.

Other aspects, objects and advantages of the present invention can be obtained from a study of the drawings, disclosure and appended claims.

The invention claimed is:

1. A launching apparatus for separating compressible work pieces from non-compressible work pieces, said launching apparatus comprised of:

a frame;

a first roller mounted on said frame;

a second roller mounted on said frame;

at least one driver in operative engagement with at least one of said first roller and said second roller such that at least said first roller rotates at a first speed;

said first roller rotating in a first direction and said second roller rotating in a substantially opposite direction;

a belt having a receiving end, said receiving end being disposed to receive an input of work pieces and said belt having an output end disposed to guide the work pieces between said first roller and said second roller;

said first roller and said second roller being configured to define a gap therebetween, said gap being dimensioned to compress a compressible work piece upon receipt of the compressible work piece from said belt; and said rotation of at least one of said first roller or said second roller in compressive contact with a compressible work piece imparting a first propulsive force on the compressible work piece, whereby the compressible work piece is propelled away from said launching apparatus.

2. Launching apparatus of claim 1 wherein said rotation of at least one of said first or said second rollers in non-compressive contact with a non-compressible work piece imparts a second propulsive force on the non-compressible work piece, said second propulsive force being less than said first propulsive force.

3. The launching apparatus of claim 1 wherein said second roller rotates at a second speed, said second speed being less than said first speed of said first roller.

4. The launching apparatus of claim 1 wherein said rollers are substantially parallel.

5. The launching apparatus of claim 1 wherein said first roller and said second roller are substantially horizontal, and said first roller is above said second roller.

6. The launching apparatus of claim 1 wherein at least one of said first roller or said second roller is moveably mounted such that said gap can widen to allow passage of a non-compressible work piece when the non-compressible work piece is wider than said gap.

7. The launching apparatus of claim 1 wherein said driver is an electric motor.

8. The launching apparatus of claim 1, further including an adjustment mechanism, said adjustment mechanism tilting the frame at an angle.

9. The launching apparatus of claim 8 wherein said adjustment mechanism is operatively connected to a front portion of the frame and a pivot is operatively connected to a rear portion of the frame.

10. The launching apparatus of claim 8, wherein said adjustment mechanism includes a pivoting support pad threaded and adjustable with respect to a support base, wherein said pivoting support pad extends and retracts from said support base, thereby lifting and lowering a front portion of said frame, respectively.

11. The launching apparatus of claim 1, wherein a launch angle is between five and twenty degrees.

12. The launching apparatus of claim 1, wherein said gap is between about 0.125 and about 4 inches.

13. The launching apparatus of claim 1, wherein said gap is between about 0.50 and about 3 inches.

14. The launching apparatus of claim 1, wherein said first roller rotation speed is substantially between one and twenty times faster than a second roller rotation speed.

15. The launching apparatus of claim 1, wherein said first roller rotation speed is substantially ten times faster than a second roller rotation speed.

16. The launching apparatus of claim 1, further including a material delivery machine operatively connected between said belt of said launcher and an automobile shredder for supplying compressible and non-compressible work pieces from the automobile shredder to said launcher.

17. The launching apparatus of claim 1, wherein said material delivery machine is a vibratory conveyor.

18. The launching apparatus of claim 1, further including sensors, said sensors being configured to sense back-up of work pieces.

19. The launching apparatus of claim 1, further including sensors located before and after said first roller and said second roller for sensing a discrepancy between an input and an output of the compressible and non-compressible work pieces.

20. The launching apparatus of claim 1, further including a hopper having a first section proximate said first roller and said second roller and a second section remote from said first roller and said second roller, said second section being disposed to receive the compressible work pieces from said launching apparatus.

21. The launching apparatus of claim 20 wherein said hopper is an adjustable splitter hopper.

22. The launching apparatus of claim 1 wherein said belt is driven by said second roller.

23. The launching apparatus of claim 1 further comprising an idler roller in operative engagement with said belt.

* * * * *